US006511127B2

(12) United States Patent
Wilkens

(10) Patent No.: US 6,511,127 B2
(45) Date of Patent: Jan. 28, 2003

(54) ROCKING MOTION IMMOBILIZER

(76) Inventor: Jeremy Wilkens, 272 Rose La., Costa Mesa, CA (US) 92627

( * ) Notice: Subject to any disclaimer, the term of this patent is extended or adjusted under 35 U.S.C. 154(b) by 0 days.

(21) Appl. No.: 09/833,932

(22) Filed: Apr. 11, 2001

(65) Prior Publication Data

US 2002/0149244 A1 Oct. 17, 2002

(51) Int. Cl.[7] ..... A47C 3/029

(52) U.S. Cl. ..... 297/270.5; 297/272.2; 248/188.8; 248/188.9; 248/346.04

(58) Field of Search ..... 297/270.1, 270.5, 297/272.1, 272.2; 248/188.8, 188.9, 188.91, 346.03, 346.04

(56) References Cited

U.S. PATENT DOCUMENTS

| | | | | | |
|---|---|---|---|---|---|
| 594,311 | A | | 11/1897 | Yehle | |
| 1,400,564 | A | | 12/1921 | Metzger | |
| 1,592,010 | A | | 7/1926 | Skidmore | |
| 1,778,685 | A | | 10/1930 | Perkins | |
| 2,020,230 | A | | 11/1935 | Beisel | |
| 4,915,335 | A | * | 4/1990 | Miles | 248/188.8 |
| 5,427,342 | A | | 6/1995 | Gagnon | |
| 5,564,782 | A | | 10/1996 | LaGrange et al. | |
| 5,820,217 | A | * | 10/1998 | Horner et al. | 248/188.8 |
| 5,991,974 | A | * | 11/1999 | Carpinella | 248/188.9 |
| 6,290,294 | B1 | * | 9/2001 | Volz | 297/270.5 |

FOREIGN PATENT DOCUMENTS

| | | | | |
|---|---|---|---|---|
| DE | 8844 | | 8/1894 | |
| FR | 1373395 | | 1/1965 | |
| FR | 1450943 | * | 8/1966 | 297/272.1 |
| GB | 2202430 | * | 9/1988 | 297/272.1 |

* cited by examiner

*Primary Examiner*—Peter R. Brown
(74) *Attorney, Agent, or Firm*—Gene Scott-Patent Law & Venture Group

(57) ABSTRACT

The present invention provides an apparatus comprising a rigid block with two rigid arms such that there is at least one flexible flap extending from each of the arms in mutual convergent attitude and biased toward a center of the space between the rigid arms. The space between the rigid arms provides integral convexly curved surface such that it enables the invention to advantageously accept a downwardly facing surface of the rocker in line contact. The invented device, wedged between a rocker of a chair and a floor surface, receives the rocker in the space between the rigid arms, upon which the flexible flaps, having by construction bias sufficient to grip of the rocker, hold the invention on the rocker so that the chair is precluded from a rocking motion and thus is immobilized. Additionally, the apparatus' surface facing a floor surface is adapted with an anti-skidding device for contact with the floor. For partial immobilization, the invented device may be used on the front or back rocker to immobilize the front or back rocking motion, respectively. Alternatively, the apparatus may be used wherein two rigid blocks placed in opposing positions on the rocker of the rocking chair and in contact with the floor surface, thus rendering the rocking chair fully immobilized.

6 Claims, 2 Drawing Sheets

ROCKING MOTION IMMOBILIZER

BACKGROUND OF THE INVENTION

1. FIELD OF THE INVENTION

This invention relates generally to rocking chair immobilizers, and more particularly to an immobilizer with features adapted to grip a rocker of a rocking chair.

2. DESCRIPTION OF RELATED ART

The following art defines the present state of this field:

Yehle, U.S. Pat. No. 594,311 describes attachments for baby-carriages having the combination of two rocker-frames provided with clips to engage the carriage-wheels, and joint or collapsible rod connections between said frames, substantially as described.

Metzger, U.S. Pat. No. 1,400,564 describes a device embodying a supporting base having two members. One of the members constituting an upright, means pivotally connecting said members whereby the said upright may be caused to assume any desired angle with respect to a supporting surface and a sign holder flexibly connected with the upright and adapted to receive and removably hold a sign, said sign holder being independent of the pivot between the members and adapted to be flexed at will with respect to the said upright and while the parts remain intact to cause the sign to assume and maintain an upright position with respect to the supporting surface in any position which the said upright may assume.

Skidmore, U.S. Pat. No. 1,592,010 describes a chair rocker shield comprising a ball-shaped protecting portion adapted to cover the outer most rear portion of a rocker, a pair of attaching flanges integral with said protecting portion and inset therefrom and disposed at an acute angle to each other to engage the upper and lower surfaces of a rocker end, a third integral flange extending transversely to said pair of flanges and effective to engage the outer surface of said rocker end, and means to secure said flanges in position.

Perkins, U.S. Pat. No. 1,778,685 describes a rocking chair having rectangular clips slidably arranged on the rockers adjacent to the rear thereof, binding means passing through the top of the clips for contacting with the upper edges of the rockers, and arched spring having a straight longitudinal extension which is received between the clip and the under face of the rocker and which is adjustably and removably held thereon by the binding means between the clip and rocker.

Beisel, U.S. Pat. No. 2,020,230 describes a device having a base section adapted to rest on a floor, a section pivoted thereto and attachable to a chair leg by a driven fastening therethrough and into the leg end, the first mentioned section having an opening therethrough to align with said driven fastening in one position of the two sections to permit moving said driven fastening relatively to the leg.

Gagnon, U.S. Pat. No. 5,427,342 describes a support providing for positioning on the base of a wooden lawn furniture leg. The support has an area that is at least five times the area of the bottom of the leg to distribute the load over a large area. This permits easy sliding of the leg across a lawn. The support is arranged to prevent prolonged contact of the leg with a source of moisture. In addition, the support provides venting to the bottom of the leg to minimize dry-rot.

LaGrange et al., U.S. Pat. No. 5,564,782 describes a protective guard for use in conjunction with a rocking chair of the type having a pair of rocker members that terminate in sharp rocker-ends including a first and second guard member each having a cavity therein of a size sufficient to receive therein one of the rocker ends and a portion of one of the rocket member; and a horizontal guard member in a manner to span a gap between a pair of rocker members. The protective guard may include a cover member, constructed of a flexible, cleanable material, having a compartment therein in connection with a first and second cover opening. The first, second and horizontal guard members are disposed within the compartment in a manner such that the first and second cavity openings are, respectively, insubstantial registration with the first and second cover openings.

The prior art teaches devices which enable immobilizing, in part or in full, a linear or rocking motion in various seating or holding arrangements. However,: the prior art does not teach that a rocking motion immobilizer may be frictionally removably attached to the rocker and may be reinforced against sliding on the floor surface by a non-skid support. Moreover, the prior art does not teach a rocking chair immobilizer which may be made at low cost, of plastic, in one piece, by an automated injection molding process. The present invention fulfills these needs and provides further related advantages as described in the following summary.

SUMMARY OF THE INVENTION

Rocking chairs are increasingly popular, particularly ones which can be used by children or elderly people. While they are esthetically and functionally attractive, they may present a threat of bodily injury to a child who is trying to climb on the chair but falls backwards as a result of a front rocking motion. The rocking chair may also be dangerous for elderly and handicapped persons when the chair is overturned by excessive back rocking movement under the heavy weight or unsecured movement of the elderly person's body. Additionally, one may simply wish to stop the motion of a rocking chair so that it may be used as a non-rocking seating facility. The present invention teaches certain benefits in construction and use which give rise to the objectives described below.

The present invention provides an apparatus comprising a rigid block with two rigid arms such that there is at least one flexible flap extending from each of the arms in a mutual convergent attitude and are biased toward a center of the space between the rigid arms. The surface of the rigid block adjacent to the space between the rigid arms provides an integral convexly curved surface such that it enables the invention to advantageously accept a downwardly facing surface of the rocker in surface-to-surface line contact. In use, the invention device is wedged between a rocker of a rocking chair and a floor surface upon which the rocking chair is rested. One of the rocking chair's rockers is inserted in the space between the rigid arms, upon which the flexible flaps, having by construction, a bias sufficient to grip of the rocker, hold the invention on the rocker so that the chair is precluded from a rocking motion and thus is immobilized. Additionally, the rigid block's surface which faces the floor surface is adapted with an anti-skidding device for contact with the floor. For partial immobilization, the invented device may be used on one of the front or back rockers to immobilize the front or back rocking motion, respectively. Alternatively, the apparatus may be used in pairs and placed in opposing positions on one rocker of the rocking chair and in contact with the floor surface, thus rendering the rocking chair fully immobilized.

A primary objective of the present invention is to provide a rocking chair immobilizer having advantages not taught by the prior art.

Another objective is provide a rocking motion immobilizer which may be easily and quickly attached by a person with no mechanical skills, and easily detached and removed when desired.

Still another objective is to provide flexible flaps integral to the body of the invention which have such bias as to enable gripping of the rocker so as to hold the apparatus securely on the rocker.

A further objective is to adapt the surface of the apparatus with an anti-skidding means for contact with a floor surface and thus enable the invented apparatus to remain firmly in place while immobilizing the rocking motion of the chair.

Still another objective is to provide a device which is made of s single piece of inexpensive plastic material, and thus is cost effective and simple to produce.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DESCRIPTION OF THE INVENTION

Figure 1:
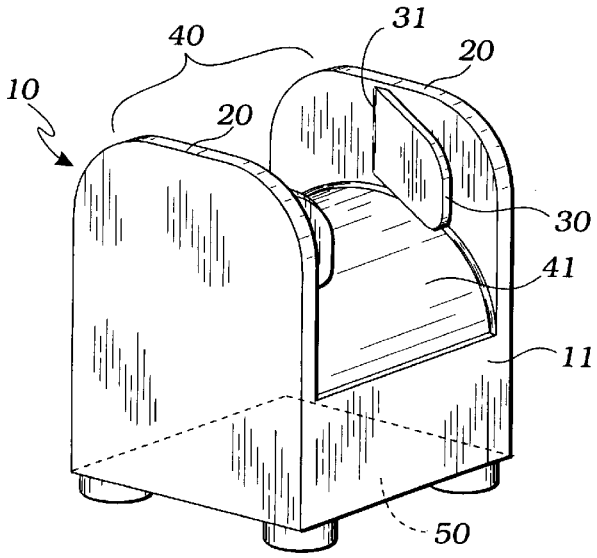
FIG. 1 is a perspective view of a preferred embodiment of the present invention showing the convexly curved surface for receiving the rocker of the rocking chair and also showing the anti-skidding means for contact of the invention with the floor surface.
Figure 2:
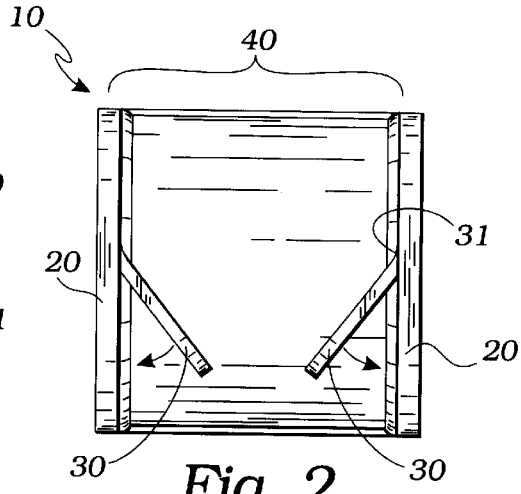
FIG. 2 is a top plan view thereof.
Figure 3:
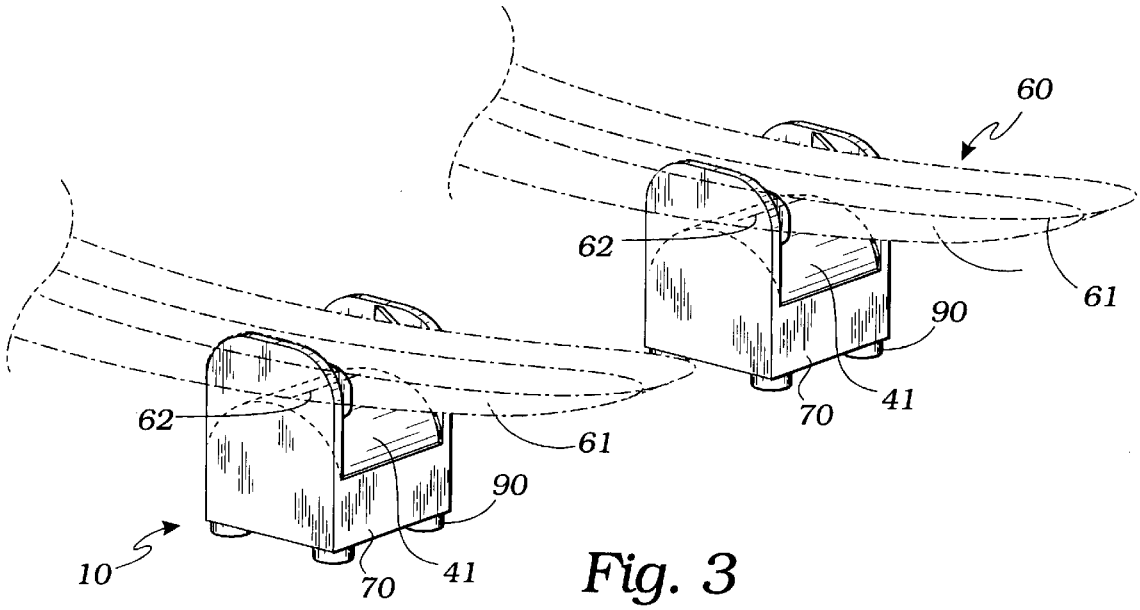
FIG. 3 is a perspective view of the invention in combination with one rocker of a rocking chair illustrating how the rocker is accepted by the convexly curved surface between the rigid arms and held by the flexible flaps.
Figure 4:
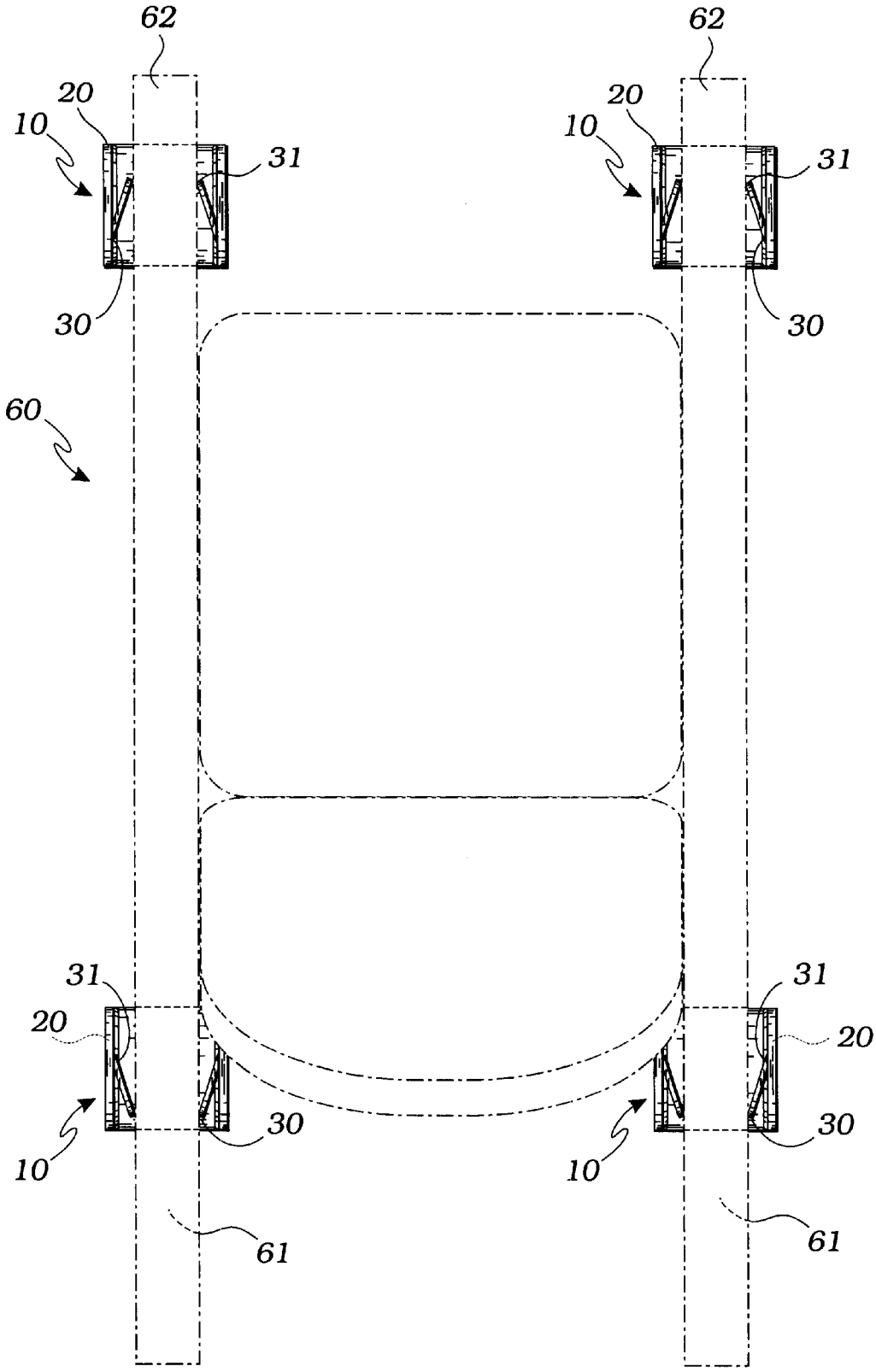
FIG. 4 is a top plain view thereof showing the present invention in use with a set of rockers of a rocking chair, using two of the present invention with each of the rockers.

The above described drawing FIGS. 1 through 3 illustrate the invention, a rocking chair immobilizer 10, dimensioned to be inserted and fit between a floor surface 80 and a rocker 60 of a rocking chair to prevent the chair from a rocking movement. In a first preferred embodiment of the invention the apparatus 10 comprises a rigid block 11 which is molded of a plastic material, such as polyethylene, polypropylene, HDPE or other cost-effective plastic material. Alternatively, the rigid block 11 may be made of wood, metal or other structural material; however using a molding process is the most cost effective and least complicated way of producing the invention. The rigid block 11 preferably provides opposing and spaced apart integral rigid arms 20 which extend in essentially parallel juxtaposition therefrom so as to define a space 40 therebetween. Preferably, the arms 20 are made of the same plastic material as the block 11 and are of a thickness which enables rigidity. Additionally, the arms 20 are preferably manufactured by the same molding process and in one piece with the block 11, i.e., the arms 20 are integral to the block 11. The space 40 between the arms 20 is dimensioned so as to receive one rocker 60 within the space 40 when the apparatus 10 is inserted to fit between the rocker 60 and the floor surface 80.

As can be best seen in FIGS. 1 and 2, each of the arms 20 preferably provides at its inner surface at least one flexible flap 30 such that a base 31 thereof intersects the arm 20 while the flaps 30 are essentially positioned within the space 40 and extend away from the arms 20 and towards each other. In the preferred embodiment the flexible flaps 30 are manufactured together with the rigid block 11 and the arms 20 in a single piece, preferably by injection molding of plastic, such as polyethylene or polypropylene. FIGS. 1 and 2 illustrate that the flaps 30 extend in mutual convergent attitude and are biased toward a center of the space 40 between the rigid arms 20. To achieve the functional flexibility required by such construction of the invention, the flexible flaps 30 are of a thickness enabling them to readily bend at the intersection 31 and have such bias as to enable gripping of the rocker 60 so as to hold apparatus 10 between them when the rocker 60 is received by the space 40 between the rigid arms 20. Alternatively, the flexible flaps may be produced separately from the rigid block 10 and made of plastic, metal, wood or other structural material. In such case, flexible attachment of the flaps 30 to the arms 20 at the proximal end 31 may be achieved by providing a means of attachment (not shown) such as a spring, or spring-activated hinge. Such attachment enables the flaps 30 to be biased towards the center of the space 40 and to maintain, a tendency to regain the original position thereof in the plane perpendicular to the arms 20 when the flaps 30 are displaced therefrom. Consequently, when the invented apparatus 10 is wedged between the rocker 60 and a floor surface 80, the rocker 60 is received in the space 40, between the flaps 30, thus forcing their disposition away from the center of the space 40. As a result of the biased nature of the flaps 30, such disposition thereof produces a spring reaction with a force directed to regain the original position of the flaps 30, and thus develops power sufficient for the flaps 30 to grip the rocker 60.

In the second preferred embodiment the block 11 of apparatus 10 has a first surface 41 integral to the space 40 which is convexly curved so as to advantageously receive a normally downwardly facing surface 61 of the rocker 60. In use, the advantage of such convex surface essentially consists in raising of a contact line between the rocker surface 61 and the first surface 41 and thus provides for a greater gripping depth between the rocker 60 and flaps 30. Consequently, such construction enhances the gripping power of the rocker 60 by the flaps 30 and thus facilitates a stronger frictionally removable attachment of the flaps 30 to the rocker 60. Additionally, the convex surface provides a smooth support surface which enables the invention to remain readily gripped to the rocker 60, and be rolled over or repositioned along the rocker 60 when it is no longer necessary to support the chair in a stable position.

In the third preferred embodiment, as can be seen in FIGS. 1 and 3, the rigid block of the apparatus 10 comprises a second surface 70 which is defined by outer surfaces of the block 11 and positioned in opposition to the first surface 41 so that the second surface 70 is enabled to make contact with the floor surface 80 through an anti-skidding means 90. Preferably, the anti-skidding means 90 comprise one or more protective feet rigidly disposed on and attached to the second surface 70 at one or more, and preferably four diagonally opposed corners thereof and extending therefrom downwardly in a generally vertical attitude such that the four protective feet 90 are enabled to contact the floor surface 80. Such attachment may be accomplished by gluing, bolting or fastening of the legs 90 to the surface 70. In the preferred embodiment, the feet 90 are made of rubber or other suitable material which possesses high traction qualities enabling better friction between the feet 90 and the floor surface 80. When the apparatus 10 is wedged between the rocker surface 60 and the floor surface 80 the invention is prevented from sliding, and the apparatus 10 holds the rocker 60 in frictional removable contact with the floor surface 80, partly immobilizing the rocking motion of the chair thereon.

The apparatus 10, as described above, can be manufactured and used in various combinations with the rocking chair. For example, a combination may comprise a rocking chair which has at least one rocker 60 for supporting the rocking chair on a floor surface 80, and an apparatus 10, positioned on the rocker in front of the chair thus partly immobilizing the rocking motion to the front so as to prevent a child climbing on the chair from falling backward due to the front rocking motion. Alternatively, the invention can be used in combination with the rocking chair wherein the apparatus 10 is positioned on the rocker 60 behind the chair. Such position will also partly immobilize the rocking motion precluding it in a backward direction and thus advantageous as to ensure protection from falling back for a heavy elderly person leaning on the back of the chair with their entire body weight. Still another combination of the rocking chair and the rocking motion immobilizer 10, is possible wherein three or four apparatuses 10 are used, two on one rocker 60, placed in opposing positions, and one or two on the other rocket 60 front or/and back. Such combination provides for a fully immobilized rocking motion of the chair in either forward or backward direction, and thus enables complete stability of the rocking chair on the floor surface 80.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination rocking chair and rocking motion immobilizer, the combination comprising:

a rocking type chair having at least one rocker for supporting the rocking chair on a floor surface;

a rigid block having opposing and spaced apart rigid arms extending in essentially parallel juxtaposition therefrom so as to define a space therebetween, the arms having flexible flaps extending in mutual convergent attitudes and biased toward a center of the space between the rigid arms;

said space between the rigid arms for accepting the at least one rocker of the rocking type chair;

the flexible flaps having such bias as to enable gripping of the rocker so as to hold the apparatus on the rocker, so that with the apparatus wedged between the rocker and a floor surface the rocking chair is partly immobilized.

2. The apparatus of claim 1 wherein a first surface of the block, said first surface being positioned between the rigid arms, is convexly curved so as to advantageously receive a normally downwardly facing surface of the rocker in line contact.

3. The apparatus of claim 2 wherein a second surface of the block, said second surface being positioned in opposition to the first surface, is adapted with anti-skidding means for contact with the floor surface.

4. A combination rocking chair and rocking motion immobilizer, the combination comprising:

a rocking type chair having at least one rocker for supporting the rocking chair on a floor surface;

a set of at least two rigid blocks, each of the rigid blocks having opposing and spaced apart rigid arms extending in essentially parallel juxtaposition therefrom so as to define a space therebetween, the arms having flexible flaps extending in mutual convergent attitudes and biased toward a center of the space between the rigid arms;

said space between the rigid arms for accepting the at least one rocker of the rocking type chair;

the flexible flaps having such bias as to enable gripping of the rocker so as to hold the apparatus on the rocker, so that with the apparatus wedged between the rocker and a floor surface the rocking chair is partly immobilized;

whereby with the two rigid blocks placed in opposing positions on the rocker of the rocking type chair and in contact with the floor surface, the rocking chair is fully immobilized.

5. The apparatus of claim 4 wherein a first surface of each of the blocks, said first surface being positioned between the rigid arms, is convexly curved so as to advantageously receive a normally downwardly facing surface of the rocker in line contact.

6. The apparatus of claim 5 wherein a second surface of each of the blocks, said second surface being positioned in opposition to the first surface, is adapted with anti-skidding means for contact with the floor surface.

* * * * *